US011238731B2

(12) United States Patent
Braeuchle et al.

(10) Patent No.: US 11,238,731 B2
(45) Date of Patent: Feb. 1, 2022

(54) METHOD AND DEVICE FOR DETECTING THE PASSAGE OF A MOTOR VEHICLE THROUGH A ROAD SIGN GANTRY

(71) Applicant: Robert Bosch GmbH, Stuttgart (DE)

(72) Inventors: Christian Braeuchle, Hassmersheim-Hochhausen (DE); Christian Jeschke, Beilstein (DE)

(73) Assignee: Robert Bosch GmbH, Stuttgart (DE)

( * ) Notice: Subject to any disclaimer, the term of this patent is extended or adjusted under 35 U.S.C. 154(b) by 504 days.

(21) Appl. No.: 15/542,457

(22) PCT Filed: Nov. 12, 2015

(86) PCT No.: PCT/EP2015/076383
§ 371 (c)(1),
(2) Date: Jul. 10, 2017

(87) PCT Pub. No.: WO2016/110350
PCT Pub. Date: Jul. 14, 2016

(65) Prior Publication Data

US 2018/0276989 A1 Sep. 27, 2018

(30) Foreign Application Priority Data

Jan. 9, 2015 (DE) ..... 10 2015 200 182.2

(51) Int. Cl.
*G08G 1/056* (2006.01)
*G08G 1/0962* (2006.01)

(52) U.S. Cl.
CPC ..... *G08G 1/056* (2013.01); *G08G 1/09623* (2013.01)

(58) Field of Classification Search
CPC ..... G01C 21/3602; G01C 21/3626; G08G 1/056
See application file for complete search history.

(56) References Cited

U.S. PATENT DOCUMENTS 8,718,919 B2 * 5/2014 Leineweber ..... G08G 1/163 180/167
2003/0174054 A1 * 9/2003 Shimomura ..... G01S 7/415 340/435

(Continued)

FOREIGN PATENT DOCUMENTS

CN 104185588 A 12/2014
DE 10 2007 048 842 A1 9/2008

(Continued)

OTHER PUBLICATIONS

International Search Report corresponding to PCT Application No. PCT/EP2015/076383, dated Feb. 19, 2016 (German and English language document) (5 pages).

*Primary Examiner* — Emily C Terrell
(74) *Attorney, Agent, or Firm* — Maginot, Moore & Beck LLP

(57) ABSTRACT

The disclosure relates to a method for detecting the passing of a motor vehicle through a road sign gantry, having the steps: receiving information on the surroundings, detecting road signs in the information on the surroundings, selecting a first road sign and a second road sign which together form a road sign gantry, acquiring position data for the first road sign and for the second road sign from the information on the surroundings, determining a gantry width between the first road sign and the second road sign, determining a first distance of the motor vehicle from the first road sign, determining a second distance of the motor vehicle from the second road sign, and detecting the passing through of the vehicle as a function of the gantry width, the first distance and the second distance.

13 Claims, 3 Drawing Sheets

(56) References Cited

U.S. PATENT DOCUMENTS

| | | | | |
|---|---|---|---|---|
| 2007/0150183 | A1 | 6/2007 | Tolmei | |
| 2011/0261168 | A1* | 10/2011 | Shima | B60T 7/22 348/47 |
| 2013/0124083 | A1* | 5/2013 | Kratzsch | G01C 21/3602 701/410 |
| 2013/0162448 | A1* | 6/2013 | Mochizuki | G08G 1/096775 340/905 |
| 2013/0261838 | A1* | 10/2013 | Schut | B60T 7/22 701/1 |
| 2016/0349072 | A1* | 12/2016 | Yoshitomi | G01C 21/3602 |

FOREIGN PATENT DOCUMENTS

| | | | |
|---|---|---|---|
| DE | 10 2014 208 662 | A1 | 3/2015 |
| GN | 100541554 | C | 9/2009 |
| GN | 101903928 | A | 12/2010 |
| GN | 103186988 | A | 7/2013 |

* cited by examiner

METHOD AND DEVICE FOR DETECTING THE PASSAGE OF A MOTOR VEHICLE THROUGH A ROAD SIGN GANTRY

This application is a 35 U.S.C. § 371 National Stage Application of PCT/EP2015/076383, filed on Nov. 12, 2015, which claims the benefit of priority to Serial No. DE 10 2015 200 182.2, filed on Jan. 9, 2015 in Germany, the disclosures of which are incorporated herein by reference in their entirety.

The present disclosure relates to a method for detecting the passage of a motor vehicle through a road-sign gantry. The disclosure further relates to a corresponding control-and-evaluation device. In addition, the disclosure relates to a corresponding computer program and to a machine-readable storage medium.

BACKGROUND

Drivers traveling the wrong way on highways—so-called ghost drivers—represent a high risk in road traffic. In the event of an accident they cause fatalities, injuries and considerable damage to property. In order to counteract this risk, one general endeavor in the automobile industry is directed toward recognizing wrong-way drivers as early as possible, in order to be able to adopt suitable countermeasures. A first approach is the recognition of a wrong-way driver solely on the basis of navigation appliances, by a road-class and also a direction of travel of one's own motor vehicle being monitored and examined for wrong-way travel. In most cases this manner of proceeding results in a recognition of wrong-way travel that comes too late, since here at the instant of recognition the wrong-way driver is already driving at high speed on an incorrect roadway. At this instant he/she is already bringing about a great risk of a collision. Especially in the case of wrong-way travel on freeways there is a particularly high risk to traffic, since by reason of the high vehicle speeds particularly serious accidents, and hence serious injuries, may occur, in some cases resulting in death.

Over 50% of the instances of wrong-way travel begin at junctions of federal freeways. Therefore many approaches for recognizing a wrong-way driver pursue the idea of detecting, as early as possible, an approach to the federal freeway at a junction in the wrong direction. A range of sensors are available in modern motor vehicles for this purpose. For example, motor vehicles are usually provided with inertial sensors—that is to say, with at least one acceleration sensor—as well as steering-angle sensors for determining states of the motor vehicle, in order to realize safety systems and comfort systems. Moreover, a large number of modern motor vehicles nowadays are provided with an integrated navigation system with determination of position. Map material for these navigation systems is also already available, said material containing supplementary information relating to the map data, such as, for example, curve radii and traffic-sign information. Furthermore, motor vehicles are already available that are equipped with a video sensor system that is designed to detect traffic signs, curve radii and other objects, and to output corresponding information.

SUMMARY

In accordance with the disclosure, a method is provided for detecting the passage of a motor vehicle through a road-sign gantry, with the following steps:

receiving environmental information, recognizing road signs in the environmental information, selecting a first road sign and a second road sign which together constitute a road-sign gantry, ascertaining position data for the first road sign and for the second road sign from the environmental information, determining a gantry width between the first road sign and the second road sign, determining a first distance of the motor vehicle from the first road sign, determining a second distance of the motor vehicle from the second road sign, and detecting the passage as a function of the gantry width, the first distance and the second distance.

The disclosure further relates to a control-and-evaluation unit that is designed to detect the passage of a motor vehicle through a road-sign gantry, said unit being designed to receive environmental information, to recognize road signs in the environmental information, to select a first road sign and a second road sign which together constitute a road-sign gantry, to ascertain position data for the first road sign and for the second road sign from the environmental information, to determine a gantry width between the first road sign and the second road sign, to determine a first distance of the motor vehicle from the first road sign, to determine a second distance of the motor vehicle from the second road sign, and to detect the passage as a function of the gantry width, the first distance and the second distance.

The novel method and the novel device are based on the idea that instances of wrong-way travel can be recognized particularly well by the fact that a wrong-way driver at a junction firstly has to drive through a road-sign gantry in order to reach the federal freeway. The detection of such a passage is already at least an indicator of an instance of wrong-way travel and can serve to recognize the wrong-way travel itself, or to postulate the hypothesis of an instance of wrong-way travel, or to verify the wrong-way travel. Consequently, by virtue of the present disclosure an efficient method is made available that enables a recognition or verification of an instance of wrong-way travel on the basis of environmental information.

The receiving of environmental information is preferentially undertaken by a camera of the motor vehicle, in particular by a video camera. The environmental information is then either video data or information that has been extracted from video data pertaining to the camera.

The recognizing of road signs in environmental information involves the identifying and verifying of an object within the environmental information as a road sign. It is particularly preferred if the type of road sign can be recognized and evaluated. In addition, it is preferred if German road sign No. 267, or corresponding road signs, is/are uniquely identified. German road sign No. 267 contains the information "Do Not Enter".

The road-sign gantry consists of at least two road signs which are arranged spaced horizontally from one another.

In addition to the road signs, the disclosure provides that the position data for the road signs are ascertained from the environmental information. In this connection it may be a question of absolute position data pertaining to the road signs—such as, for example, GPS coordinates—or of relative position data pertaining to the road signs relative to the motor vehicle. The gantry width can then be ascertained from the position data themselves by simple mathematical operations. In like manner, the first and the second distance of the motor vehicle from the respective road signs can then also be ascertained.

The detection of passage itself is finally undertaken as a function of these three measurements: gantry width, first distance and second distance. By suitable mathematical linkage, it can be ascertained when the vehicle is located in front of, within, alongside or behind the gantry, viewed in the direction of travel.

In the case where more than two road signs are recognized within the environmental information, several road-sign gantries are also generated, which can be processed individually.

For the purpose of determining the gantry width, use may be made of a variant of Pythagoras's theorem, for example. It then holds that:

$$t_{i,j}=\sqrt{(y_i-y_j)^2+(x_i-x_j)^2}$$

In this case, $t_{i,j}$ is the gantry width between road sign i and road sign j; $x_i$, $x_j$, $y_i$, $y_j$ represent corresponding x-coordinates and y-coordinates of the respective road signs i and j. Alternatively, approximations to Pythagoras's theorem are also conceivable. For example, it may also be assumed that the length of the longer short side plus half the length of the shorter short side corresponds approximately to the length of the hypotenuse. By this means, additional computational power can be saved.

In corresponding manner, the calculation of the first and second distances of the vehicle from the respective road signs can also be ascertained. Here, it then holds that:

$$d_{f,k}=\sqrt{(y_f-y_k)^2+(x_f-x_k)^2}$$

where $d_{f,k}$=the distance of the vehicle from sign k. Correspondingly, $x_f$ and $y_f$ are coordinates of the motor vehicle, and $x_k$ and $y_k$ are coordinates of sign k.

Overall, in this way a method is made available that is able to ascertain, at an early stage and in very reliable manner, the passage of the motor vehicle through a road-sign gantry. As already stated, it is particularly preferred if this is linked with additional information such as, for example, a type of road sign that can indicate a prohibition of passage, or even navigation data that can demonstrate proximity to a freeway entrance.

In a further configuration of the disclosure, the following additional step is provided: checking the gantry width for plausibility, whereby a road-sign gantry with implausible gantry width is discarded.

In this configuration, the method is optimized to the effect that road-sign gantries that are implausible are discarded, so that an examination is eliminated. The gantry width itself is used as criterion for plausibility. 'Discarding' here means, in particular, that the road-sign gantry in question will not be taken into consideration any further for a detection of passage. Only a gantry width that satisfies a predefined minimum and/or a maximum can be employed meaningfully for the method. This is an advantage in particular for the reason that the road-sign gantries can be assembled arbitrarily from several road signs. A vehicle width or a road width, for example, may be used as a minimum for a gantry width.

In a further configuration of the disclosure, the method has the following additional steps: ascertaining an angle between a straight line, defined by a road-sign gantry, and an axis of the motor vehicle, and checking the angle for plausibility, whereby a road-sign gantry with implausible angle is discarded.

In this configuration, the efficiency of the method is also increased by checking the plausibility of the road-sign gantries. As a criterion for plausibility, here an orientation of the road-sign gantry relative to the motor vehicle is used. The straight line is defined by the road-sign gantry by virtue of the fact that this virtual straight line extends from the first road sign to the second road sign. Furthermore, the axis of the motor vehicle is preferentially a longitudinal axis or transverse axis. A corresponding criterion for the plausibility of the corresponding angle then depends on the type of axis. For example, in the case of the use of a longitudinal axis of the motor vehicle a road-sign gantry would be plausible if the longitudinal axis of the motor vehicle were arranged substantially parallel to or at a very acute angle to the straight line. A relatively obtuse angle or, in particular, a 90° angle would, on the other hand, be an indication that the vehicle is oriented toward the road-sign gantry. In the first-mentioned case, the road-sign gantry would be implausible, whereas in the second case it would be plausible. With respect to discarding, reference is made to the above comments.

In a further configuration of the disclosure, the passage is detected as a function of the following formula:

$$t_{i,j}=d_{f,i}+d_{f,j}$$

where: $t_{i,j}$=gantry width; $d_{f,i}$=the first distance (26); $d_{f,j}$=second distance (28).

In this configuration, a concrete equation is made available that describes the dependence between the gantry width $t_{i,j}$, the first distance $d_{f,i}$ and the second distance $d_{f,j}$. The formula signifies that passage must occur when the two distances correspond in total to the gantry width itself. This case obtains when the motor vehicle—more precisely, the sensor of the motor vehicle that has acquired the environmental information—is arranged precisely between the first road sign and the second road sign. The passage is accordingly detected when the aforementioned formula contains a true assertion. Consequently a very simple calculation of passage is possible. It is particularly preferred if, for the purpose of checking the plausibility of the formula, several temporally staggered examinations of this formula are undertaken, which may demonstrate a plausible temporal progression.

In a further configuration of the disclosure, a temporal progression of the sum of the first and second distances is checked, whereby a passage is detected when a minimum and/or a point of inflection is ascertained.

In this configuration, not only the exact instant of passage is detected, but the entire progression—from approach, during passage, to driving away from the road-sign gantry—is acquired. In addition, here too the gantry width can be taken into consideration, so that the temporal progression can be ascertained by the following formula:

$$f(t)=t_{i,j}-(d_{f,i}+d_{f,j})$$

The parameters $t_{i,j}$, $d_{f,i}$ and $d_{f,j}$ are each dependent on the time t. A particular advantage in this connection is that an exact satisfaction of the condition is not necessary, but rather a temporal progression is made possible by a minimum/maximum inspection and/or an inflection-point analysis.

In a further configuration of the disclosure, the position data are additionally determined as a function of a trajectory of the motor vehicle.

In this configuration, the determination of the position data is improved to the effect that the direction of travel and speed of the motor vehicle are taken into consideration. For example, position data from the environmental data may be obsolete, since seconds may pass until said data are actually used. The trajectory of the motor vehicle can be taken into consideration in this case, so that after ascertainment of the position data the position data that are actually available at the time of the result are ascertained directly. By this means, a particularly precise ascertainment of the position data is made possible.

In a further configuration of the disclosure, the trajectory is ascertained by means of initial sensors.

In this configuration, the trajectory of the motor vehicle is ascertained on the basis of measurement data pertaining to inertial sensors. As already stated at the outset, present-day motor vehicles frequently already have inertial sensors, so this represents a particularly economical possibility in order to ascertain the trajectory of a motor vehicle.

In a further configuration, a future trajectory of the motor vehicle is predicted, and a future passage is determined as a function of the future trajectory.

In this configuration, a particularly reliable detection of passage is made available, said detection taking place before the passage itself takes place. By predication of the trajectory of the motor vehicle and hence by the predication of the possible and probable locations of the motor vehicle in the future, it can be ascertained whether a passage is probable in future. For this purpose, a recalculation of the distances as a function of the trajectory for various future instants can be undertaken. The method according to the disclosure can then be applied to these virtual future instants, as stated above.

It will be understood that the aforementioned features and the features still to be elucidated below can be used not only in the respective specified combination but also in other combinations or on their own, without departing from the scope of the present disclosure.

BRIEF DESCRIPTION OF THE DRAWINGS

Embodiments of the disclosure are represented in the drawing and will be elucidated in greater detail in the following description. Shown are.

DETAILED DESCRIPTION

Figure 1:
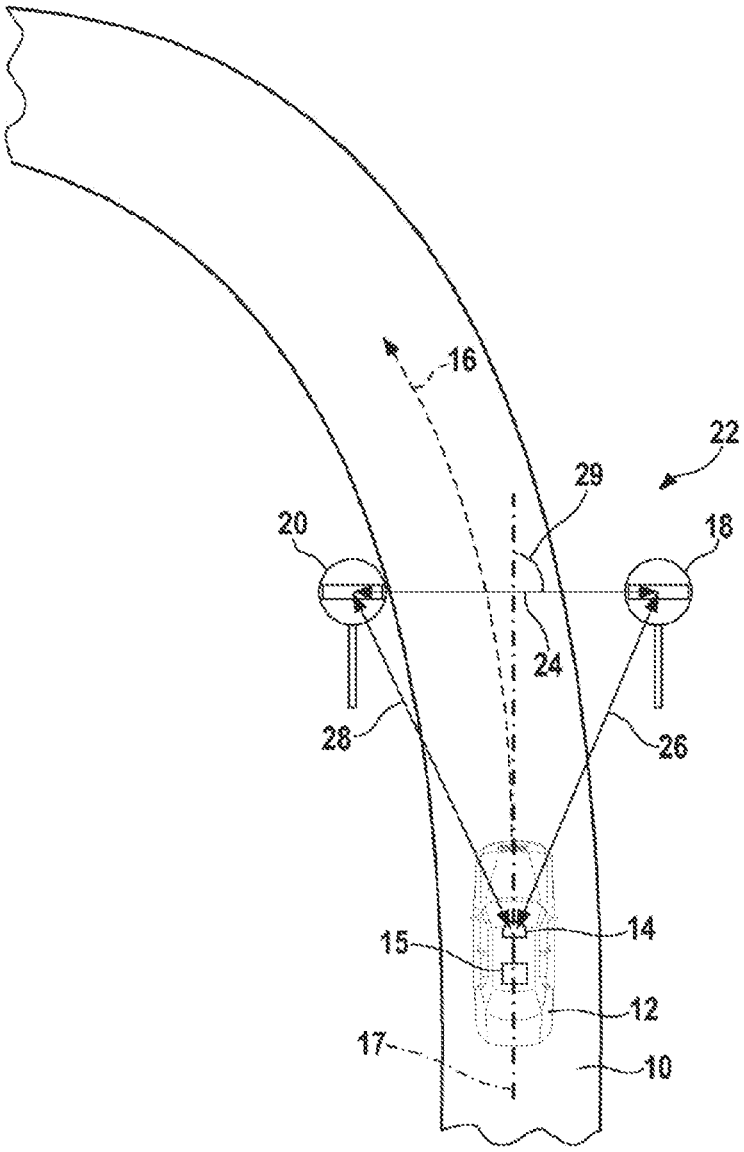
FIG. 1 a potential wrong-way-driving situation.

FIG. 1 shows a road 10 along which a motor vehicle 12 is moving. The road 10 represents a freeway exit on which the motor vehicle 12 is in transit in the wrong direction of travel. The motor vehicle 12 has a camera 14 which records environmental information from an environment of the motor vehicle 12. This environmental information is then processed within a control-and-evaluation unit 15.

The motor vehicle 12 is moving along on a trajectory 16 on the road 10. In addition, the motor vehicle exhibits a longitudinal axis 17 which defines the instantaneous orientation of the trajectory 16. The trajectory 16 passes between a first road sign 18 and a second road sign 20. The first road sign 18 and the second road sign 20 jointly constitute a road-sign gantry 22. The road-sign gantry 22 exhibits a gantry width 24. In addition, the motor vehicle 12 exhibits a first distance 26 from the first road sign 18, and a second distance 28 from the second road sign 20. As can be discerned from FIG. 1, the reference-point of the motor vehicle 12 is the camera 14. The distances 26 and 28 are ascertained here starting from this reference-point.

As can be discerned from FIG. 1, a passage through the road-sign gantry 22 can be recognized by the fact that the distances 26 and 28 correspond in total to the gantry width 24. In this case, the camera 14 is located precisely level with the gantry width 24.

Furthermore, by this means it is discernible that a plausibility check of passage is possible by means of an imaginary angle 29 between the longitudinal axis 17 of the vehicle and the straight line 24. In the case represented here, a plausibility check is possible by virtue of the fact that the longitudinal axis 17 of the vehicle must be arranged substantially at 900 to the straight line 24 between the first road sign 18 and the second road sign 20. If this is not the case, or if the longitudinal axis 17 of the vehicle is arranged substantially parallel to or at a very acute angle to this straight line 24, a passage is not to be expected, and the road-sign gantry 22 would have to be discarded as implausible.

Figure 2:
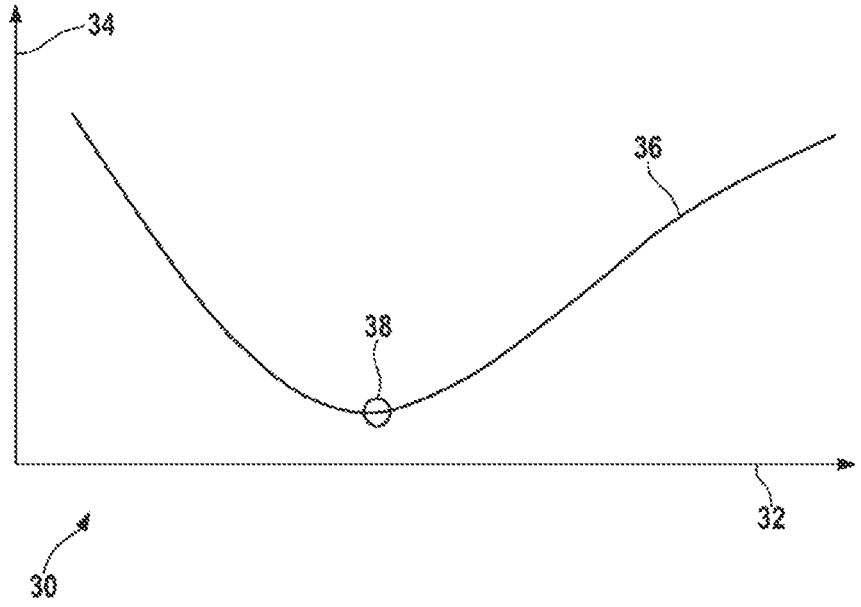
FIG. 2 an exemplary temporal progression of $f(t)=t_{i,j}-(d_{f,i}+d_{f,j})$, and FIG. 3 a flow chart of the method according to the disclosure.

FIG. 2 shows a Cartesian coordinate system 30 with an abscissa 32 on which the time t has been plotted. In addition, the Cartesian coordinate system 30 exhibits an ordinate 34 which represents a temporal progression of the gantry width 24 minus a sum of the distances 26 and 28 as a function. Accordingly, it holds that: $f(t)=t_{i,j}-(d_{f,i}+d_{f,j})$.

The temporal progression of this function is represented by the curve 36. The global minimum 38 here indicates the instant of passage of the motor vehicle 12 through the road-sign gantry 22. In an ideal case, the minimum would be equal to zero. However, this does not necessarily have to be the case—for example, due to uncertainties of measurement or temporal delays.

By evaluation of the progression 36, a very robust and reliable detection of passage, in particular of the instant of passage through the road-sign gantry 22, is consequently possible.

Figure 3:
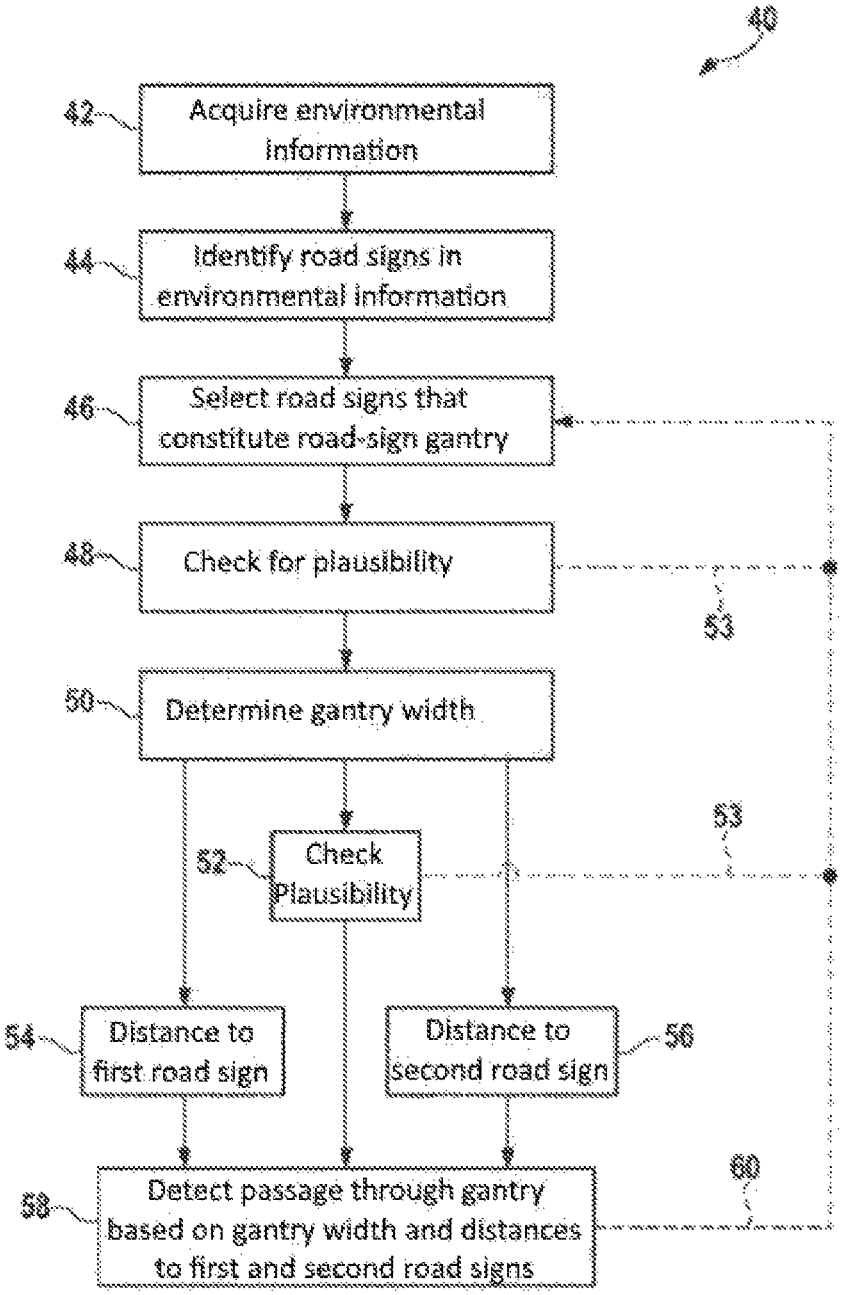

FIG. 3 shows a flow chart 40 of the method according to the disclosure.

The method begins in a step 42, in which environmental information from the camera 14 is acquired by the control-and-evaluation unit 15.

In a step 44, the road signs 18 and 20 in the environmental information are recognized by the control-and-evaluation unit 15.

In the following step 46, the control-and-evaluation unit 15 selects the first road sign 18 and the second road sign 20, which as a result constitute the road-sign gantry 22.

In a subsequent step 48, the road-sign gantry 22 is checked for plausibility. For this purpose, the angle 29 between the longitudinal axis 17 of the vehicle and the straight line 24 between the first road sign 18 and the second road sign 20 is ascertained. Provided this angle 29 substantially represents a 90° angle or does not exceed a threshold value for a too acute angle, the road-sign gantry 22 is not discarded, and the method is continued to step 50. In step 50, the road-sign gantry 22 is then gauged, by the gantry width 24 between the first road sign 18 and the second road sign 20 being ascertained.

The gantry width 24 is then forwarded to step 52. In step 52, the gantry width 24 is then checked for plausibility. This is done by a comparison of the gantry width 24 with a parameter stored in the control-and-evaluation unit 15. Here the parameter is a minimum gantry width that must obtain. If the minimum gantry width of the gantry does not obtain, the method is terminated at this point.

As is represented in FIG. 3, the method can terminate prematurely in steps 48 and 52. In these cases the disclosure may also provide that the method is reset via arrows 53 to step 46, and a further road-sign gantry is ascertained there.

This can be undertaken until such time as all possible road-sign gantries have been examined.

In step 54, the first distance 26 of the motor vehicle 12 from the first road sign 18 is then determined. Correspondingly, the second distance 28 of the motor vehicle 12 from the second road sign 20 is determined in step 56.

Finally, the first distance 26, the second distance 28 and the gantry width 24 are transferred to step 58. In step 58, the passage is then determined as a function of these three items of information.

Hence, as soon as the road-sign gantry 22 has been processed, the method can once again be reset via arrow 60 to step 46 where a further road-sign gantry can then be examined.

The invention claimed is:

1. A method for detecting a passage of a motor vehicle on a road through a road-sign gantry, the method comprising:

receiving environmental information at a control-and-evaluation unit from a sensor on the motor vehicle;

recognizing road signs in the environmental information using the control-and-evaluation unit;

determining a correct direction of travel for the road using the control-and-evaluation unit;

selecting a first road sign and a second road sign of the recognized road signs arranged on opposing sides of the road opposite from each other, the first road sign and the second road sign together constituting the road-sign gantry;

ascertaining position data for the first road sign and for the second road sign from the environmental information using the control-and-evaluation unit;

determining a gantry width between the first road sign and the second road sign;

determining a first distance of the motor vehicle from the first road sign using the control-and-evaluation unit;

determining a second distance of the motor vehicle from the second road sign using the control-and-evaluation unit; and detecting the passage of the motor vehicle through the road-sign gantry as a function of the gantry width, the first distance, and the second distance using the control-and-evaluation unit, the passage of the motor vehicle through the road-sign gantry indicating that the motor vehicle is traveling in a wrong direction on the road; and further comprising:

checking the gantry width for plausibility; and discarding the road-sign gantry in response to the gantry width being implausible.

2. The method according to claim 1, further comprising:

ascertaining an angle between a straight line defined by the road-sign gantry and an axis of the motor vehicle; and checking the angle for plausibility; and discarding the road-sign gantry in response to the angle being implausible.

3. The method according to claim 1, the detecting of the passage further comprising:

detecting the passage of the motor vehicle through the road-sign gantry as a function of whether a sum of the first distance and the second distance corresponds to the gantry width.

4. The method according to claim 1, the detecting of the passage further comprising:

detecting the passage of the motor vehicle through the road-sign gantry in response to at least one of a minimum and a point of inflection being reached in a temporal progression of a sum of the first distance and the second distance.

5. The method according to claim 1, further comprising:

determining the position data as a function of a trajectory of the motor vehicle.

6. The method according to claim 5, further comprising:

ascertaining the trajectory of the motor vehicle using initial sensors.

7. The method according to claim 1, further comprising:

predicting a future trajectory of the motor vehicle; and determining a future passage of the motor vehicle through the road-sign gantry as a function of the future trajectory.

8. A control-and-evaluation unit for detecting a passage of a motor vehicle through a road-sign gantry, the control-and-evaluation unit being configured to:

receive environmental information pertaining to a road;

recognize road signs in the environmental information;

identify a correct direction of travel for the road;

select a first road sign and a second road sign of the recognized road signs arranged on opposing sides of the road, the first road sign and the second road sign together constituting the road-sign gantry;

ascertain position data for the first road sign and for the second road sign from the environmental information;

determine a gantry width between the first road sign and the second road sign;

determine a first distance of the motor vehicle from the first road sign;

determine a second distance of the motor vehicle from the second road sign; and detect the passage of the motor vehicle through the road-sign gantry as a function of the gantry width, the first distance, and the second distance, the passage of the motor vehicle through the road-sign gantry indicating that the motor vehicle is traveling in a wrong direction on the road; and the control-and-evaluation unit being further configured to:

check the gantry width for plausibility; and discard the road-sign gantry in response to the gantry width being implausible.

9. A non-transitory computer program product that, when executed by a control-and-evaluation unit, is configured to cause the control-and-evaluation unit to:

receive environmental information pertaining to a road;

recognize road signs in the environmental information;

identify a correct direction of travel for the road;

select a first road sign and a second road sign of the recognized road signs arranged on opposing sides of the road, the first road sign and the second road sign together constituting the road-sign gantry;

ascertain position data for the first road sign and for the second road sign from the environmental information;

determine a gantry width between the first road sign and the second road sign; determine a first distance of a motor vehicle from the first road sign;

determine a second distance of the motor vehicle from the second road sign; and detect a passage of the motor vehicle through the road-sign gantry as a function of the gantry width, the first distance, and the second distance, the passage of the motor vehicle through the road-sign gantry indicating that the motor vehicle is traveling in a wrong direction on the road; and further configured to cause the control-and-evaluation unit to:

check the gantry width for plausibility; and discard the road-sign gantry in response to the gantry width being implausible.

10. The non-transitory computer program product of claim 9, wherein the computer program product is stored on a non-transitory machine-readable storage medium.

11. The method of claim 1, further comprising:

determining that the passage of the motor vehicle through the gantry is indicative of the vehicle traveling in the wrong direction on the road.

12. The method of claim 1, wherein determining a correct direction of travel for the road comprises:

identifying the correct direction of travel based on the recognized road signs.

13. The method of claim 1, wherein determining a correct direction of travel for the road comprises:

using navigation data from a navigation system of the vehicle to determine the correct direction of travel for the road.

* * * * *